US006619019B2

(12) United States Patent
Bates

(10) Patent No.: US 6,619,019 B2
(45) Date of Patent: Sep. 16, 2003

(54) SADDLES

(75) Inventor: Ronald Gordon Bates, Mt. Lawley (AU)

(73) Assignee: Hammersmith Nominees Pty LTD, Perth (AU)

( * ) Notice: Subject to any disclaimer, the term of this patent is extended or adjusted under 35 U.S.C. 154(b) by 0 days.

(21) Appl. No.: 09/953,456

(22) Filed: Sep. 12, 2001

(65) Prior Publication Data

US 2002/0078666 A1 Jun. 27, 2002

Related U.S. Application Data

(63) Continuation-in-part of application No. 09/809,824, filed on Mar. 15, 2001.

(30) Foreign Application Priority Data

Mar. 23, 2000 (AU) ..... PQ6416/00

(51) Int. Cl.[7] ..... B68C 1/08

(52) U.S. Cl. ..... 54/44.6; 54/44.5; 54/44.1

(58) Field of Search ..... 54/1, 44, 44.1, 54/44.6, 66

(56) References Cited

U.S. PATENT DOCUMENTS

| | | | | | |
|---|---|---|---|---|---|
| 3,343,338 | A | * | 9/1967 | Stuebben | 54/44 |
| 4,033,097 | A | * | 7/1977 | Petit | 54/44 |
| 4,471,538 | A | | 9/1984 | Pomeranz et al. | |
| 4,683,709 | A | | 8/1987 | Vasko et al. | |
| 4,695,496 | A | | 9/1987 | Lee | |
| 4,745,734 | A | * | 5/1988 | Brown | 54/44 |
| 4,840,425 | A | * | 6/1989 | Noble | 297/284 |
| 4,974,397 | A | | 12/1990 | Ricken | |
| 5,018,341 | A | | 5/1991 | Evertson | |
| 5,027,589 | A | * | 7/1991 | Gleb et al. | 54/66 |
| 5,299,412 | A | | 4/1994 | Cudney et al. | |
| 5,329,751 | A | | 7/1994 | Wadsworth | |
| 5,363,631 | A | | 11/1994 | Garrison | |
| 5,517,808 | A | * | 5/1996 | Schleese | 54/44.6 |
| 5,555,710 | A | | 9/1996 | Smith | |
| 5,685,133 | A | | 11/1997 | Travis | |
| 5,782,070 | A | | 7/1998 | Knight et al. | |
| 5,787,692 | A | * | 8/1998 | Purdy | 54/66 |
| 5,802,823 | A | * | 9/1998 | Woods | 54/66 |
| 6,050,067 | A | * | 4/2000 | Knight et al. | 54/44.6 |

FOREIGN PATENT DOCUMENTS

| | | |
|---|---|---|
| AU | 23770/92 | 11/1993 |
| AU | 49621/93 | 8/1994 |
| CH | 446 045 | 3/1968 |
| DE | 2 133 034 | 1/1973 |
| DE | 2 259 376 | 6/1974 |
| DE | 24 28 852 | 1/1976 |
| DE | 41 36 907 | 5/1992 |
| DE | 41 00 027 | 7/1992 |
| DE | 41 14 433 | 11/1992 |
| DE | 94 11 519.2 | 11/1994 |
| DE | 199 47 304 | 4/2001 |
| EP | 0 060 449 | 9/1985 |
| EP | 0 328 376 | 10/1991 |
| EP | 0 764 607 | 5/2000 |
| FR | 2 632 623 | 12/1989 |
| FR | 2 667 584 | 4/1992 |
| GB | 434459 | 9/1935 |
| GB | 1 453 810 | 10/1976 |
| GB | 2 090 512 | 7/1982 |

(List continued on next page.)

*Primary Examiner*—Charles T. Jordan
*Assistant Examiner*—Bret Hayes
(74) *Attorney, Agent, or Firm*—Knobbe, Martens, Olson & Bear, LLP

(57) ABSTRACT

A saddle for equestrian use has panels having sealed air bags filled with air at atmospheric pressure to permit an even pressure to be applied over the back of a horse. The interior of the panel above the air bags is filled with packing material to permit adjustment of the fit of the saddle on the horse throughout the working life of the saddle.

18 Claims, 7 Drawing Sheets

FOREIGN PATENT DOCUMENTS

| | | |
|---|---|---|
| GB | 2 108 362 | 5/1983 |
| GB | 2 259 436 | 3/1993 |
| GB | 2 279 546 | 1/1995 |
| GB | 2 282 742 | 4/1995 |
| GB | 2 304 521 | 3/1997 |
| GB | 2 308 799 | 7/1997 |
| GB | 2 336 092 | 10/1999 |
| WO | PCT/US92/04279 | 11/1993 |
| WO | PCT/US97/24134 | 7/1998 |
| WO | PCT/DK98/00371 | 4/1999 |

* cited by examiner

SADDLES

CROSS REFERENCE TO RELATED APPLICATION

This application is filed as a continuation-in-part of application Ser. No. 09/809,824 filed Mar. 15, 2001.

BACKGROUND OF THE INVENTION

1. Field of the Invention

The present invention relates to saddles for equestrian use.

2. Description of the Prior Art

A conventional saddle has at its underside panels of a compressible structure intended to spread the weight of the rider over the back of the horse. Conventionally, the panels consist of an envelope into which a packing of wool or comparable synthetic material is inserted by hand. In principle, the packing formed by the wool or other filling is intended to conform to the shape of the horse's back and thereby to spread the load while minimising pressure points on the horse's back. When a saddle is used only on one horse, the panels of the saddle will, over a period of time, compress and set to take on the shape of the particular horse's back. However the extent of possible compression which occurs in the packing is relatively limited and unless the saddle tree is shaped to the exact conformity of the horse, pressure points often arise where too much of the weight of the rider is transferred to the horse's back in specific areas. This results in the skin not receiving sufficient blood flow which reduces the ability of the skin to sweat and if this situation continues for a long period of time it can result in hair loss, sore back, and possible muscle damage to the horse. These problems are compounded when, and as often happens, the saddle is used on more than one horse and whereby the compression needed to properly bed the saddle down onto the horse will not arise.

SUMMARY OF THE INVENTION

According to the present invention, there is provided a saddle for equestrian use, the saddle having panels, each panel containing a plurality of sealed air bags and, externally of the air bags in relation to the horse, a packing capable of adjustment, a separate said air bag being at least in a forward part and a rearward part of the panel and each bag in use serving to apply a relatively even pressure to the back of the horse.

Advantageously each air bag is substantially flat and is substantially filled within its interior with a resiliently compressible open cell foam.

In a preferred embodiment of the invention, the bags within each panel are formed into a single unit for insertion into the panel.

Advantageously, the external surface of each bag or of the bag unit carries a lining to prevent damage to the bags during insertion of, or re-packing of, the packing.

Further according to the invention, there is provided a saddle for equestrian use, the saddle having panels, each panel carrying a plurality of sealed air bags at an underside thereof, and a lining layer externally of the air bags in relation to the horse, a separate said air bag being at least at a forward part and a rearward part of the panel and each bag in use serving to apply a relatively even pressure to the back of the horse.

BRIEF DESCRIPTION OF THE DRAWINGS

Embodiments of the invention will now be described, by way of example only, with reference to the accompanying drawings in which.

DESCRIPTION OF THE PREFERRED EMBODIMENTS

Figure 1:
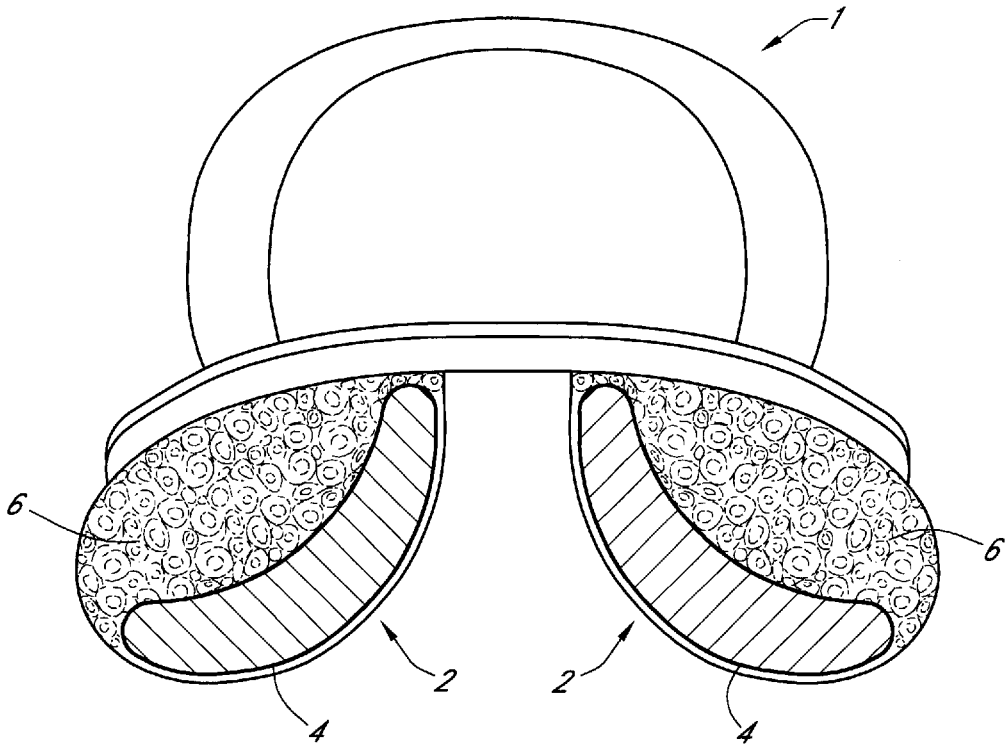
FIG. 1 is a schematic cross-section of a saddle in accordance with a first embodiment of the invention showing the saddle panels containing an air bag arrangement and adjustable packing externally of the air bags.

As shown in FIG. 1, a saddle 1 in accordance with one embodiment of the invention is, save for filling within panels 2, of known construction using leather, synthetic materials, or a combination of leather and synthetic materials. In accordance with this embodiment of the invention, each of the panels 2 defines an envelope which receives an arrangement of air bags 4 and, above the air bags 4 either along the entire length of the panel 2 or at selected positions, packing 6 preferably in the form of a wool stuffing is placed. The air bags 4 are arranged sequentially in a fore-aft direction within the panel 2. There may be just two such air bags 4 forming front and rear air bags 4 collectively extending the length of the panel 2 or there may be three or possibly more such air bags 4 consisting of a front, a rear, and one or more intermediate air bags 4 collectively extending the length of the panel 2. The respective air bags 4 are sealed and as a result air will not flow between the bags 4. It is to be noted that if only a single air bag were to be used extending the length of the panel 2 substantial air movement would occur from the front to the back of the panel 2 when the air bag is under pressure during use and this could result in the formation of pressure points. Although with the arrangement now proposed air movement will occur within each individual bag 4 when under load, the extent of air movement is inherently restricted by the length of the bag 4.

Figure 2:
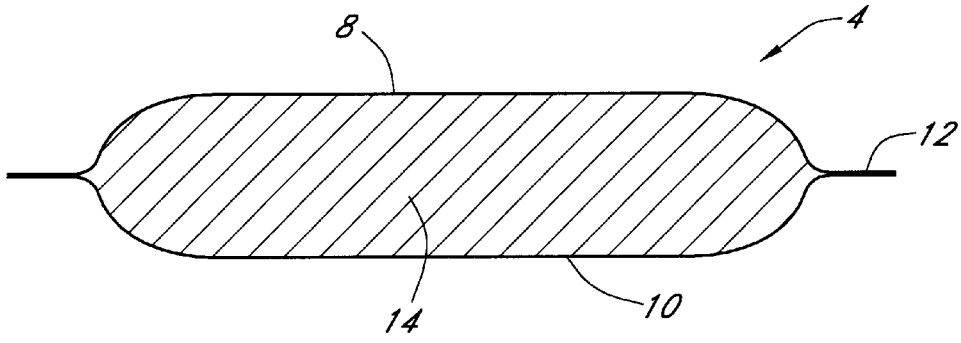
FIG. 2 is a cross-section through an individual air bag.
Figure 3:
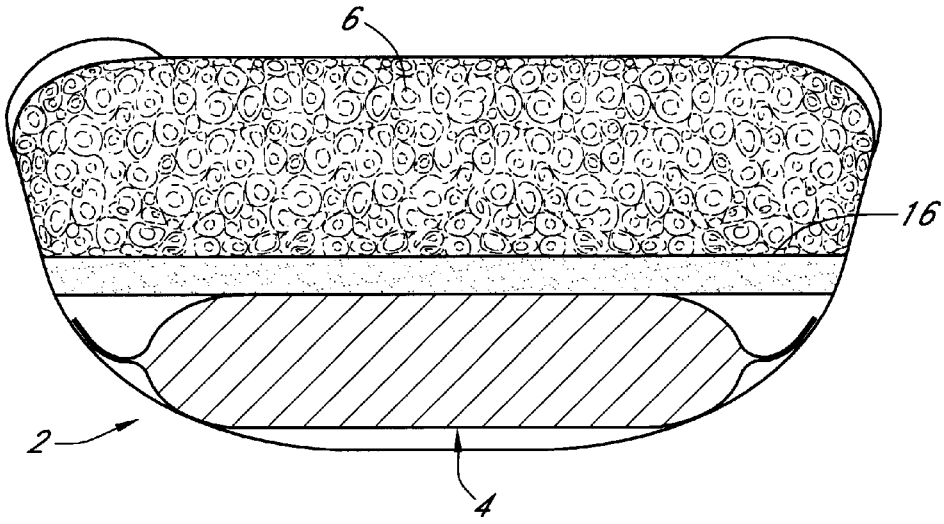
FIG. 3 is a section showing schematically the configuration of the air bag, an associated liner, and packing within the panel.

With reference to FIG. 2, each air bag 4 is formed by upper and lower sheets 8,10 of impervious material such as PVC sealed together around the periphery 12 with each bag 4 having a filling 14 consisting of a layer of an open cell resiliently compressible foam. The air bags 4 are not inflated with air at above atmospheric pressure but, rather, contain air at substantially atmospheric pressure which is sealed within the bag during manufacture, with the open cell foam filling 14 occupying substantially the entirety of the interior of the bag 4. The resulting air bag 4 is substantially flat and of substantially even thickness throughout.

Figure 4:
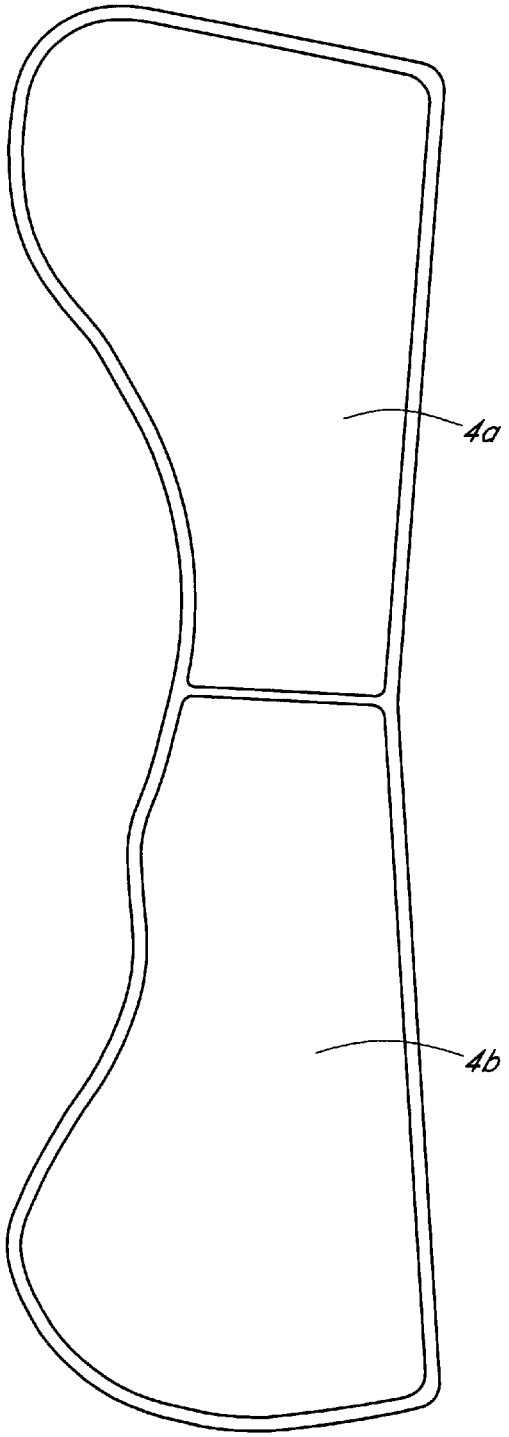
FIG. 4 is an underneath plan view showing an air bag unit consisting of front, and rear air bags.
Figure 5:
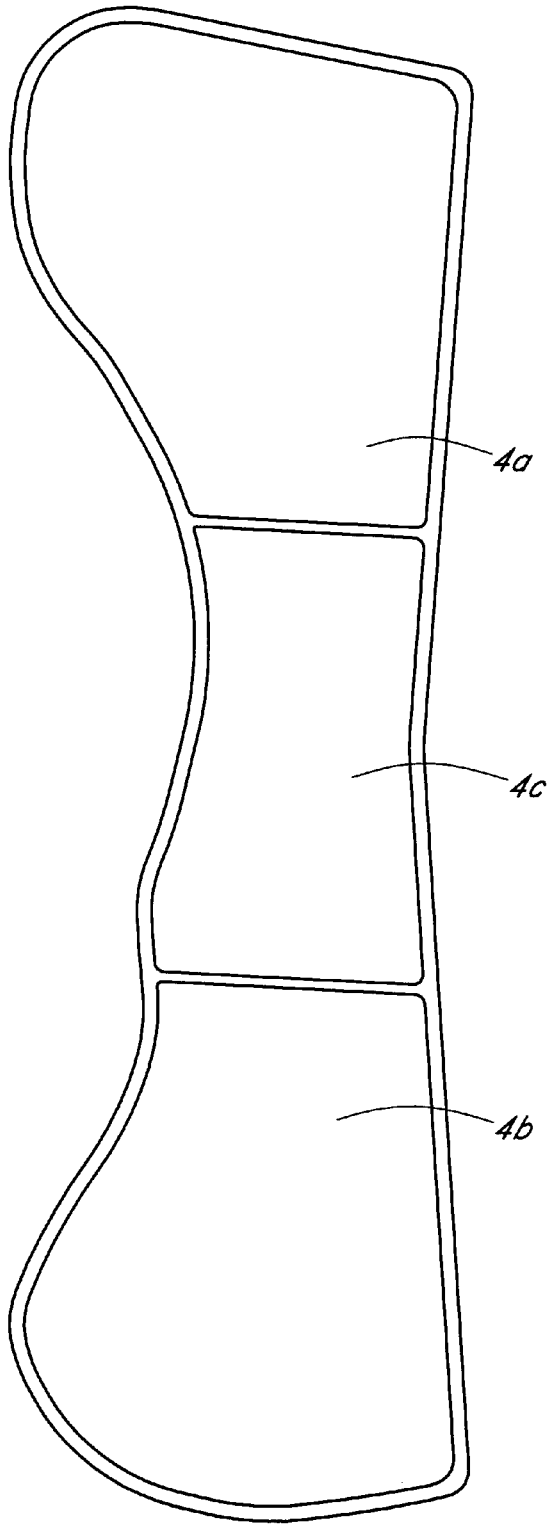
FIG. 5 is an underneath plan view of an air bag unit consisting of front, intermediate, and rear air bags.

The two or more air bags 4 are fitted into the panel 2 and then the wool or other appropriate packing 6 is placed above the air bags 4 where required. Advantageously, the two or more bags 4 are formed into an air bag unit by attaching a layer 16 of flexible lining material to the upper surface of the air bags 4, for example by gluing. The lining 16 will inhibit the air bags 4 from being punctured while the wool or other packing 6 is being inserted and also serves to consolidate the two or more bags 4 into a single unit to facilitate assembly. The lining 16 may include felt or a suitable plastics material such as PVC. FIG. 4 shows an air bag unit including front and rear air bags 4*a,* 4*b* respectively and FIG. 5 shows an air bag unit comprising front, intermediate, and rear air bags 4*a,* 4*c,* 4*b* respectively. The packing 6 will normally be added in the part of panel 2 which guides the knee of the rider, and at the rear of the panel 2 where extra depth is required. Very little packing 6 is likely to be required in the middle part of the panel 2 although it can be added if required.

The effect of the air bag 4 arrangement is that, in use, air will move within each separate bag 4 and an even pressure will be applied over the entire surface of each air bag 4 at the front or back of the saddle 1 thereby eliminating individual pressure points on the back of the horse, in contrast to conventional saddles where significant pressure variation on the horses back can arise within a relatively small area. The application of the even pressure over the surface of the bag 4 is expected to substantially remove possibility for muscle damage and it is expected that this will result in a much freer and more comfortable movement of the horse in use.

A significant advantage of using the air bag arrangement in combination with appropriate packing 6 is that is possible for saddlers to re-adjust the fit of the saddle 1 to optimize the effects of the air bag 4 arrangement at any time throughout its life thereby providing substantial flexibility in use. The re-adjustment, which is accomplished by adjusting the position of the packing 6 or by re-packing, is a straightforward task for a saddler and the presence of the lining above the air bags 4 will ensure the integrity of their bags 4 during this process.

It will be understood that although a number of different plastics materials will have substantial impermeability to passage of air and will form suitable materials for the air bags 4, absolute impermeability might not always be achieved with the result that minor amounts of air might displace through the bag wall when the bag 4 is under heavy loading during prolonged use resulting in minor deflation which does not, however, adversely affect the performance of the bag 4, but under normal usage this should not occur. However should minor deflation occur under the circumstances discussed above, when the saddle 1 is removed from the horse and the air bag 4 is no longer under load, it has been determined that the expansion of the open cell foam filling 14 within the bag 4 from its previously. compressed state does, over a period of time (such as several weeks), cause air to be drawn back into the interior of the bag 4 to establish pressure equilibrium across the wall of the bag 4. However, it is envisaged that if air loss through the bag wall during use does present a problem, laminates can be used which will totally eliminate air loss although these laminates can be relatively expensive and will therefore lead to increased costs.

Figure 6:
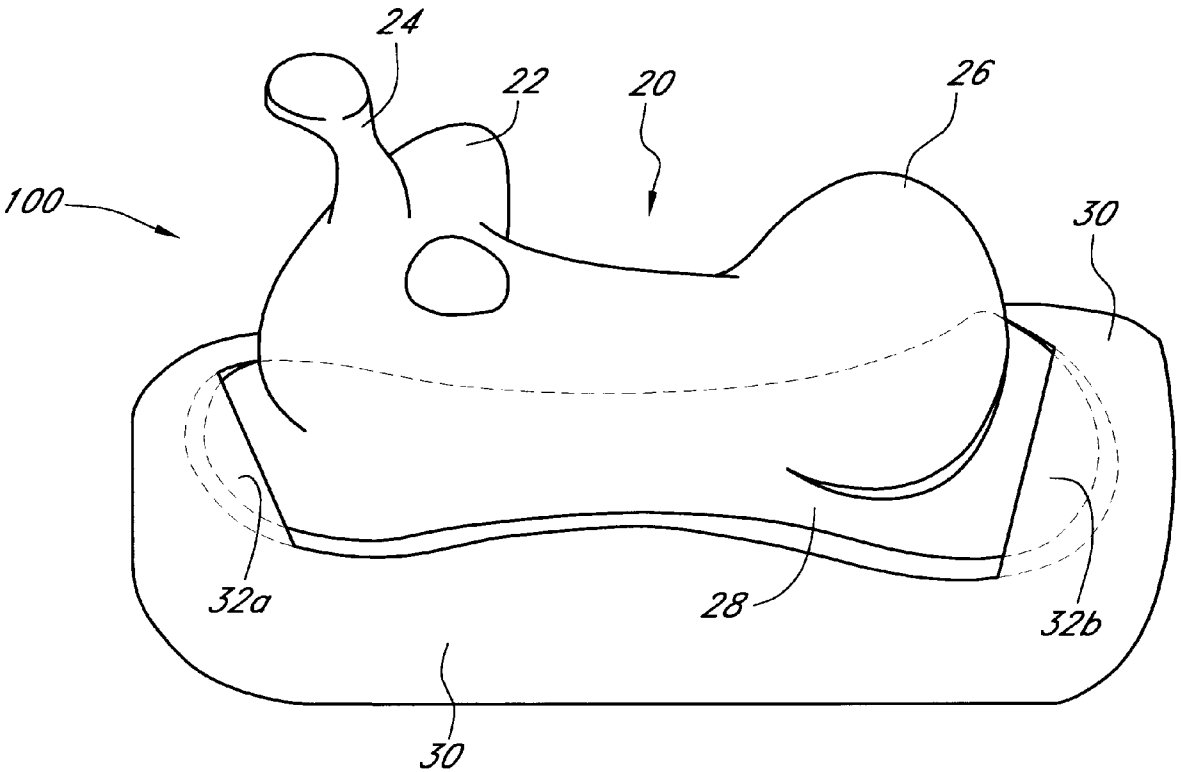
FIG. 6 is a perspective view of a saddle in accordance with the second embodiment of the invention.
Figure 7:
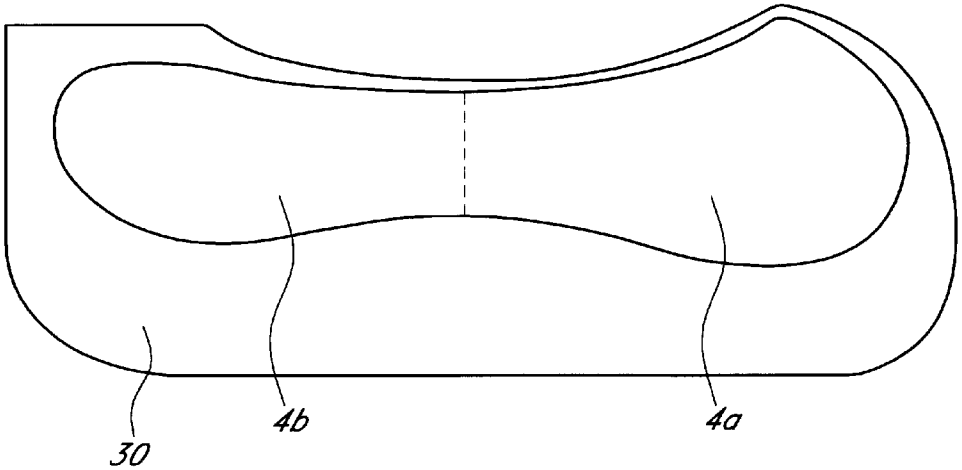
FIG. 7 is a view from underneath of the one of the panels of the saddle of FIG. 6 but with an underneath lining removed to show air bags at the underside of the panel.
Figure 8:
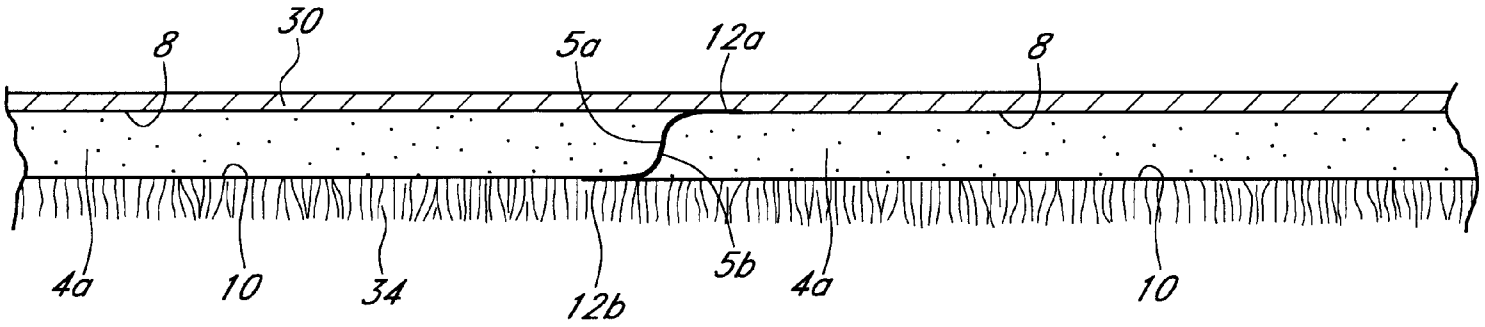
FIG. 8 is a schematic cross-section through one of the panels of the saddle of FIG. 6 in the zone of connection between adjacent air bags associated with that panel.

FIGS. 6 to 8 show an embodiment of a Western saddle 100 incorporating the invention. The saddle 100 comprises a tree 20 of conventional construction which provides a front swell 22 and horn 24 and a rear cantle 26. Elongate bars 28 which form part of the tree 20 and which are known as tree bars extend along both sides of the tree 20 and rest on the back of the horse via saddle panels 30. Each tree bar 28 is attached to the top of the associated panel 30, for example by fitting the front and rear end portions of the bar 28 into front and rear pockets 32*a,* 32*b* respectively on the upper surface of the panel 30. Each panel 30 typically includes a layer of a firm or hard leather or a suitable synthetic material having on its underside a lining 34 (see FIG. 8) of sheepskin or a synthetic fleece and which lies against the horse.

As shown in FIG. 7, in accordance with certain aspects of the invention, two or more air bags 4 as previously described are incorporated between the lining 34 and the underside of the panel 30. As shown, there are front and rear air bags 4*a,* 4*b,* although in alternative arrangements there may be front, intermediate, and rear air bags 4*a,* 4*b,* 4*c* as previously described with reference to FIG. 5. As previously described, the two or more air bags 4 associated with each panel 30 may be formed into a single unit. The zone of the underside of the panel 30 to which the air bags 4 are mounted substantially corresponds to the zone of the upper surface of the panel 30 engaged by the tree bar 28.

The two or more air bags 4, or the air bag unit, may be fixed in position by being glued to the underside of the panel 30. Alternatively, or in addition, the lining 34 may be stitched to the panel 30 slightly outside of the periphery of the air bags 4 or air bag unit to form a pocket within which the air bags 4 or air bag unit is enclosed; such stitching may be via an intermediate layer of sheet material such as plastic, light leather, or felt, between the lining 34 and the outer surface of the air bags 4.

In a conventional Western saddle, the loading applied by the tree bars to the panels is distributed over the back of the horse by the use of very thick saddlecloths laid over the horse's back before application of the saddle. The use of the air bags 4 in accordance with the invention obviates the need to use saddlecloths of this type.

Although the adjacent air bags 4 associated with each panel 30 may be configured as described with reference to FIGS. 2, 4, and 5, it has been determined that it is particularly advantageous for the upper and lower sheets 8,10 forming each bag 4 to be sealed in a sealing zone lying substantially in the place of one of the two sheets 8,10 rather than lying intermediate the planes of the two sheets 8, 10 as shown in FIG. 2. Accordingly, (and as shown in FIG. 8) the seals of the adjacent air bags 4*a,* 4*b* associated with each panel 30 are arranged so that the seal 12*a* of one air bag (as shown, the bag 4*a*) is arranged in the plane of the upper sheet 8 of that bag 4 and the seal 12*b* of the adjacent air bag 4 (as shown, the bag 4*b*) is in the plane of the lower sheet 10 of that bag 4. With this configuration, the side edges 5*a,* 5*b* of the main bodies of the two adjacent air bags 4 can be mounted in close proximity with the seal 12*a* of the first air bag 4 forming an upper flap which extends over and is adhered to the upper surface of the second air bag 4 and the seal 12*b* of the second air bag 4 extends beneath and is adhered to the lower surface of the first air bag 4. With this configuration, the adjacent side edges 5*a,* 5*b* of the bodies of the two air bags 4 will tightly abut in the manner shown in FIG. 8 to provide a very even and "seamless" loading transition between the two air bags 4.

In minor modification to further improve the abutting joint between the adjacent side edges of adjacent bags 4, the foam layer adjacent the joint is formed with a chamfer or skive, with the two chamfers being oppositely directed so that one faces upwardly and the other downwardly to ensure tight abutment of the adjacent sides of the two bags 4, along an inclined plane thus forming effectively, a skive joint between the two bags 4, with the skive joint being enclosed from above and below by upper and lower flaps formed from the abutting layers of the two sheets 8, 10 forming each 4 bag in the zone of the seal between the two sheets 8,10. The seal itself may be at the extreme outer edge of those flaps. The modified structure just described further improves the "seamless" feel of the transition between adjacent bags 4.

The seamless transition structure between adjacent air bags 4 as just described can also be incorporated to advantage in the embodiment of the saddle 1 described with reference to FIGS. 1 to 5.

The embodiment had been described by way of example only and modifications are possible within the scope of the invention.

What is claimed is:

1. A saddle for equestrian use, the saddle having panels, each panel containing a plurality of sealed air bags and, at the side of the air bags remote from a horse, a packing capable of adjustment, a separate said air bag being at least in a forward part and a rearward part of the panel and each bag in use serving to apply a relatively even pressure to the back of the horse, each air bag being substantially flat and being substantially filled within the interior with a resiliently compressible open cell foam, and the bags within each panel being formed into a single unit for insertion into the panel, wherein said unit comprises separate air bags attached to a layer of flexible lining material, said flexible layer lying between the bags and the packing and serving also to inhibit puncturing of the bags during insertion of the bags during insertion of the packing into the panel.

2. A saddle for equestrian use, the saddle having panels, each panel containing a plurality of sealed air bags and, at a side of the air bags remote from a horse, a packing capable of adjustment, a separate said air bag being at least in a forward part and a rearward part of the panel and each bag in use serving to apply a relatively even pressure to the back of the horse, each air bag being substantially flat and being substantially filled within its interior with a resiliently compressible open cell foam, wherein each said bag comprises opposed layers of sheet material sealed together at adjacent edges such that air at substantially atmospheric pressure is enclosed within the bag.

3. A saddle according to claim 2, wherein the bags are constructed of sheet material which is substantially impervious to a passage of air therethrough but which is, under exposure to prolonged loading during use of the saddle, susceptible to minor leakage of air through the bag resulting in deflation of the bag from its non-loaded configuration, the arrangement being such that upon removal of the loading, consequent expansion of the bag to its non-loaded configuration by re-expansion of the foam filling will cause atmospheric air to be drawn back into the interior of the bag over a substantial period of time.

4. A saddle for equestrian use, the saddle having panels, each panel containing a plurality of sealed air bags and, at a side of the air bags remote from a horse, a packing capable of adjustment, a separate said air bag being at least in a forward part and a rearward part of the panel and each bag in use serving to apply a relatively even pressure to the back of the horse, each air bag being substantially flat and being substantially filled within the interior with a resiliently compressible open cell foam, wherein each bag is filled with air at substantially atmospheric pressure.

5. A saddle for equestrian use, the saddle having panels, each panel containing a plurality of sealed air bags and, at a side of the air bags remote from a horse, a packing capable of adjustment, a separate said air bag being at least in a forward part and rearward part of the panel and each bag in use serving to apply a relatively even pressure to the back of the horse, each air bag being substantially flat and being substantially filled within its interior with a resiliently compressible open cell foam, and the bags within each panel being formed into a single unit for insertion into the panel, wherein said air bags are positioned in said panel to provide a forward, intermediate, and rear air bag in end-to-end relation.

6. A saddle for equestrian use, the saddle having panels, each panel containing a plurality of sealed air bags and, at a side of the air bags remote from a horse, a packing capable of adjustment, a separate said air bag being at least in a forward part and a rearward part of the panel and each bag in use serving to apply a relatively even pressure to the back of the horse, each air bag being substantially flat and being substantially filled within its interior with a resiliently compressible open cell foam, and the bags within each panel being formed into a single unit of insertion into the panel, wherein the air bags are arranged in the panel to provide a forward and rear air bag in end-to-end relation.

7. A saddle for equestrian use, the saddle having panels, each panel carrying a plurality of sealed air bags at an underside thereof, and a lining layer of a side of the air bags adjacent a horse, a separate said air bag being at least at a forward part and a rearward pat of the panel and each bag in use serving to apply a relatively even pressure to the back of the horse, each air bag being substantially flat and being substantially filled within its interior with resiliently coresessible open cell foam, wherein each said bag comprises opposed layer of sheet material sealed together at adjacent edges such that air at substantially atmospheric pressure is enclosed within the bag.

8. A saddle according to claim 7, wherein the bags are constructed of sheet material which is substantially impervious to a passage of air therethrough but which is, under exposure to prolonged loading during use of the saddle, susceptible to minor leakage of air through the bag resulting in deflation of the bag from its non-loaded configuration, the arrangement being such that upon removal of the loading, consequent expansion of the bag to its non-loaded configuration by re-expansion of the foam filling will cause atmospheric air to be drawn back into the interior of the bag over a substantial period of time.

9. A saddle for equestrian use, the saddle having panels, each panel carrying a plurality of sealed air bags at an underside thereof, and a lining layer at a side of the air bags adjacent to a horse, a separate said air bag being at least at a forward part and a rearward part of the panel and each bag in use serving to apply a relatively even pressure to the back of the horse, each air bag being substantially flat and being substantially filled within its interior with resiliently compressible open cell foam, wherein each bag is filled with air at substantially atmospheric pressure.

10. A saddle for use, the saddle having panels, each panel carrying a plurality of sealed air bags at an underside thereof, and a lining layer at a side of air bags adjacent a horse, a separate said air bag being at least at a forward part and a rearward part of the panel and each bag in use serving to apply a relatively even pressure to the back of the horse, each air bag being substantially flat and being substantially filled within its interior with resiliently compressible open cell foam, and the bags associated with each panel being formed into a single unit for mounting to the panel, wherein the air bags are arranged to provide a forward and rear air bag in end-to-end relation.

11. A saddle for equestrian use, the saddle having panels, each panel carrying a plurality of sealed air bags at an underside thereof, and lining layer at a side of the air bags adjacent a horse, a separate said air bag being at least at a forward and a rearward part of the panel and each bag in use serving to apply a relatively even pressure to the back of the horse, wherein the lining is attached to an underside of the panel in a zone thereof outside of a zone occupied by the air bags.

12. A saddle according to claim 7, wherein adjacent side walls of adjacent bags are in abutting engagement to substantially prevent discontinuity of pressure application to the back of the horse in the transition between adjacent bags.

13. A saddle according to claim 12, wherein the sheet material forming each of the adjacent bags forms a seam extending from one of the upper or lower surfaces of said bag beyond said side wall thereof to engage the corresponding upper or lower surface of the adjacent bag beyond the said side wall thereof whereby said seam overlaps the abutting side walls.

14. A saddle for equestrian use, the saddle having panels, each panel continuing a plurality of sealed air bags and, at a side of the air bags remote from a horse, a packing capable of adjustment, a separate said air bag being at least in a forward part and a rearward part of the panel and each bag in use serving to apply a relatively even pressure to the back of the horse, each air bag being substantially flat and being substantially filled within its interior with a resiliently compressible open cell foam, wherein each said bag comprises opposed layers of sheet material sealed together at adjacent edges such that air at substantially atmospheric pressure is enclosed within the bag, and wherein adjacent side walls of adjacent bags are in abutting engagement to substantially prevent discontinuity of pressure application to the back of the horse in the transition between adjacent bags.

15. A saddle according to claim 14, wherein the sheet material forming each of the adjacent bags forms a seam extending from one of the upper or lower surfaces of said bag beyond said side wall thereof to engage the corresponding upper or lower surface of the adjacent bag beyond the said side wall thereof whereby said seam overlaps the abutting side walls.

16. A saddle for equestrian use, said saddle comprising a tree with elongate tree bars extending along opposite sides of the tree and opposed panels each mounted to a respective one of the tree bars such that loading from the tree is applied to the panels via the tree bars, each panel carrying a plurality of sealed air bags at an underside thereof, and a lining layer at a side of the air bags adjacent a horse, a separate said air bag being at least at a forward part and a rearward part of the panel and each air bag in use serving to apply a relatively even pressure to the back of the horse consequent on the loading applied to the panel by the associated tree bar, wherein the air bags are applied to a zone of the underside of the panel corresponding to a zone of the upper side of the panel to which loading is applied by the associated tree bar.

17. A saddle for equestrian use, the saddle having panels, each panel carrying a plurality of air bags at an underside thereof and lying adjacent a part of each panel which contacts the back of a horse whereby the bags provide a padding effect to distribute to the back of the horse the loading arising in use of the saddle, each air bag being of a material which is substantially impervious to passage of air therethrough, each air bag being substantially flat and being filled with a predetermined volume of air at substantially atmospheric pressure at the time of manufacture without the need for inflation to a higher pressure for usage of the air bags, and each air bag being substantially filled within its interior with a resiliently compressible open cell foam, whereby the padding effect of the air bag in use of the saddle is provided by the combined effects of the air sealed within the bag and the foam filling.

18. A saddle for equestrian use, the saddle comprising a tree with elongate tree bars extending along opposite sides of the tree, and opposed panels mounted to a respective one of the tree bars such that loading from the tree is applied to the panels via the tree bars, each panel carrying a plurality of air bags at an underside thereof whereby the bags provide a padding effect to distribute to the back of a horse loading arising in use of the saddle, each air bag being of a material which is substantially impervious to passage of air therethrough, each air bag being substantially flat and being filled with a predetermined volume of air at substantially atmospheric pressure at the time of manufacture without the need for inflation to a higher pressure for usage of the air bags, and each air bag being substantially filled within its interior with a resiliently compressible open cell foam, whereby the padding effect of the air bag in use of the saddle is provided by the combined effects of the air sealed within the bag and the foam filling.

* * * * *

UNITED STATES PATENT AND TRADEMARK OFFICE

CERTIFICATE OF CORRECTION

PATENT NO. : 6,619,019 B2
DATED : September 16, 2003
INVENTOR(S) : Ronald Gordon Bates It is certified that error appears in the above-identified patent and that said Letters Patent is hereby corrected as shown below:

Column 6,
Lines 19-20, following "within its interior with resiliently" delete "core-sessible" and insert -- compressible --

Signed and Sealed this

Nineteenth Day of October, 2004

JON W. DUDAS
*Director of the United States Patent and Trademark Office*